US009074334B2

(12) United States Patent
Palmlund et al.

(10) Patent No.: US 9,074,334 B2
(45) Date of Patent: Jul. 7, 2015

(54) POST DRIVER AND PULLER

(75) Inventors: Matt Palmlund, Bancroft, SD (US); Leroy B. Stumpe, Hartford, SD (US)

(73) Assignee: Sioux Steel Company, Sioux Falls, SD (US)

( * ) Notice: Subject to any disclaimer, the term of this patent is extended or adjusted under 35 U.S.C. 154(b) by 917 days.

(21) Appl. No.: 13/042,626

(22) Filed: Mar. 8, 2011

(65) Prior Publication Data

US 2011/0240321 A1 Oct. 6, 2011

(51) Int. Cl.

| | |
|---|---|
| ***B25D 9/00*** | (2006.01) |
| ***B25D 11/00*** | (2006.01) |
| ***B25D 13/00*** | (2006.01) |
| ***E21B 1/00*** | (2006.01) |
| ***E02D 13/00*** | (2006.01) |
| ***E04H 17/26*** | (2006.01) |

(52) U.S. Cl.

CPC ..... *E02D 13/00* (2013.01); *E04H 17/263* (2013.01); *E04H 17/265* (2013.01)

(58) Field of Classification Search

CPC ..... E02D 7/06; B66F 3/00; B66F 3/005; B25C 5/10; B25C 11/00; B25C 3/008; B25F 3/00; B25F 1/006; B25F 1/003; B25B 7/22; B66C 1/427; B66C 1/58

See application file for complete search history.

(56) References Cited

U.S. PATENT DOCUMENTS

| | | | | | |
|---|---|---|---|---|---|
| 2,688,233 | A | * | 9/1954 | Craig et al. | 173/25 |
| 3,497,017 | A | * | 2/1970 | Henderson et al. | 173/18 |
| 3,715,039 | A | * | 2/1973 | Kollmann et al. | 212/349 |
| 3,919,816 | A | * | 11/1975 | Ranft | 52/116 |
| 4,139,067 | A | | 2/1979 | Craig | |
| 4,204,625 | A | * | 5/1980 | Glenn | 227/76 |
| 4,256,286 | A | | 3/1981 | Hudgins | |
| 4,457,645 | A | * | 7/1984 | Klochko | 299/37.3 |
| 4,555,090 | A | * | 11/1985 | Averhoff | 254/29 R |
| 5,012,873 | A | * | 5/1991 | Kennedy et al. | 173/185 |
| 5,269,107 | A | * | 12/1993 | Klemm | 52/115 |
| 6,857,619 | B1 | | 2/2005 | Jangula | |
| 2015/0047861 | A1 | * | 2/2015 | Hull | 171/1 |

FOREIGN PATENT DOCUMENTS

| | | | | |
|---|---|---|---|---|
| GB | 2435292 | | 8/2007 | |
| GB | 2435292 | A * | 8/2007 | E04H 17/26 |
| WO | 2010028356 | | 3/2010 | |

OTHER PUBLICATIONS

The International Bureau of WIPO, Notification Concerning Transmittal of International Preliminary Report on Patentability and Preliminary Report on Patentability, Report, Mar. 17, 2011, pp. 1-9, The International Bureau of WIPO, Geneva, Switzerland.

* cited by examiner

*Primary Examiner* — Robert Long

(74) *Attorney, Agent, or Firm* — Jeffrey A. Proehl; Woods, Fuller, Shultz & Smith, P.C.

(57) ABSTRACT

A post driving and removal system comprising a base frame for mounting on a mobile base, a gripping apparatus mounted on the base frame and configured to selectively grip a post, and a driver apparatus mounted on the base frame and configured to impact a post held by the gripping apparatus.

19 Claims, 11 Drawing Sheets

POST DRIVER AND PULLER

REFERENCE TO RELATED APPLICATION

This application claims the benefit of U.S. Provisional Patent Application No. 61/191,342, filed Sep. 8, 2008, and Patent Cooperation Treaty Application No. PCT/US2009/056214, filed Sep. 8, 2009, which are hereby incorporated by reference herein in their entireties.

BACKGROUND

1. Field

The present disclosure relates to fence post handling equipment and more particularly pertains to a new post driver and puller for providing a simple and compact system to accomplish both of these tasks without switching between different implements.

2. Description of the Prior Art

The placement of a post in the ground, such as for the purpose of creating a fence, can be a difficult and tedious task. Typically, a hole is formed in the ground using a post hole digger, which employs an auger which resembles an oversized drill bit. While effective for forming a hole, the post hole digger can be difficult and dangerous to use, especially if a stone is struck by the tip of the auger, and then rather than the auger turning, it becomes stationary and the rest of the digger apparatus begins turning instead. These post hole forming devices have been mounted on vehicles to ease the movement of the post hole digger between post locations along the desired fence line, and to help minimize the danger involved. However, these devices do nothing to move the post to the location of the hole that has been created by digger, or to help place the post in the hole. Furthermore, the hole created by the auger is typically larger in diameter than the post, and the hole must be backfilled with soil and the soil tamped after the post is inserted in the hole in order to secure the post against leaning.

Thus, the conventional method of installing posts is believed to be slower and more time consuming than need be, and it is believed that a quicker and easier way of accomplishing this task.

SUMMARY

In view of the foregoing disadvantages inherent in the known types of post handling equipment now present in the prior art, the present disclosure describes a new post driver and puller which may be utilized for providing a simple and compact system to accomplish both of these tasks without switching between different implements.

The present disclosure relates to a post driving and removal system that may comprise a base frame for mounting on a mobile base, a gripping apparatus mounted on the base frame and configured to selectively grip a post, and a driver apparatus mounted on the base frame and configured to impact a post held by the gripping apparatus.

In another aspect, the disclosure relates to a post driving and removal system that comprises a base frame and mounting structure mounted on the base frame and configured to mount the base frame on a mobile base. The system further comprises a gripping apparatus mounted on the base frame and configured to selectively grip a post. The gripping apparatus includes a pinching member and a first movement assembly. The pinching member is movably mounted on the base frame, and is movable between pinch position to grip the post against the base frame and a release position to release the post from being gripped between the pinching member and the base frame. The first movement assembly is configured to move the pinching member between the pinch position and the release position. The system further comprises a driver apparatus mounted on the base frame and being configured to impact a post held by the gripping apparatus. The driver apparatus comprises an arm, an impact member, and a second movement assembly. The arm is movable with respect to the base frame between the raised position and a lowered position. The impact member is mounted on the arm and being movable with the arm to impact the post gripped by the gripping apparatus. The second movement assembly is configured to move the arm between the raised position and the lowered position.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components, as well as the particulars of the steps of use set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
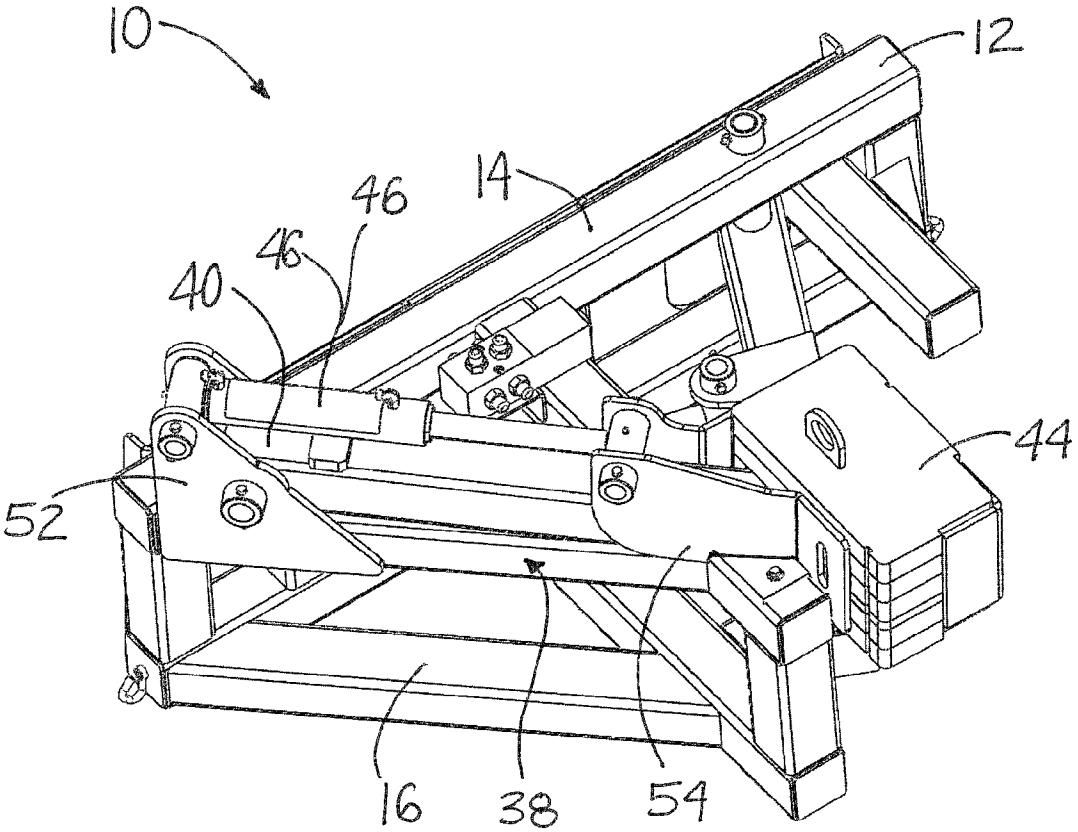
FIG. 1 is a schematic perspective view of a new post driver and puller according to the present disclosure.
Figure 2:
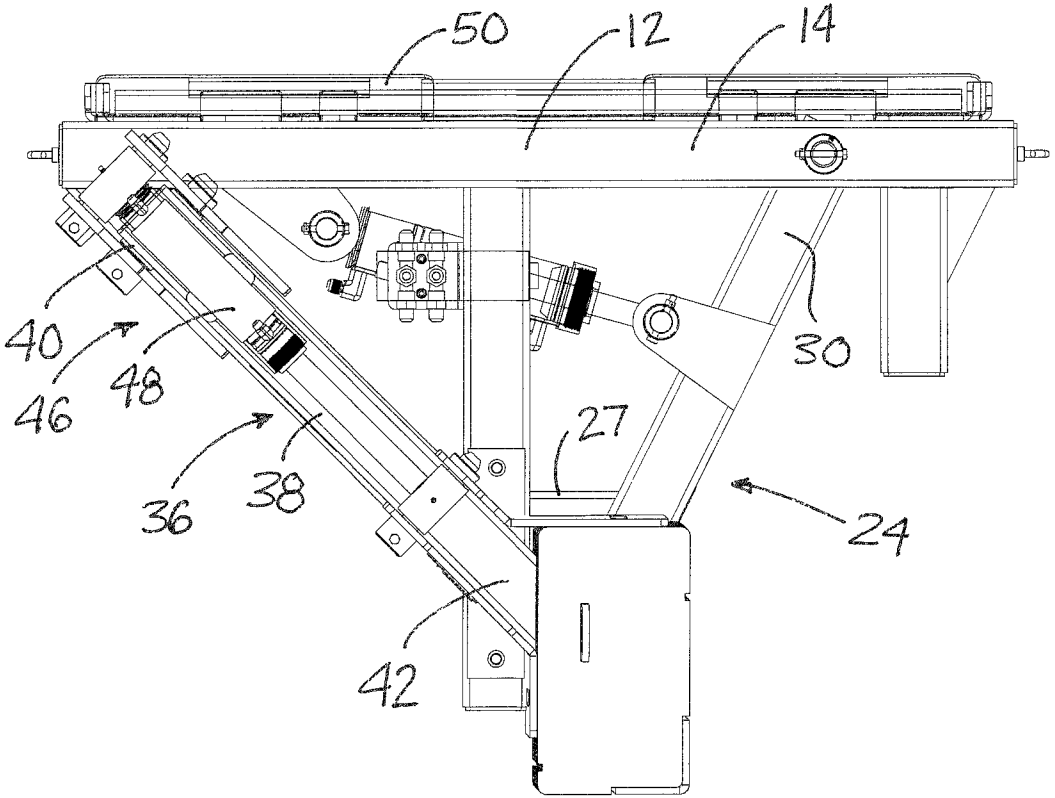
FIG. 2 is a schematic top view of the post driver and puller, according to an illustrative embodiment.
Figure 3:
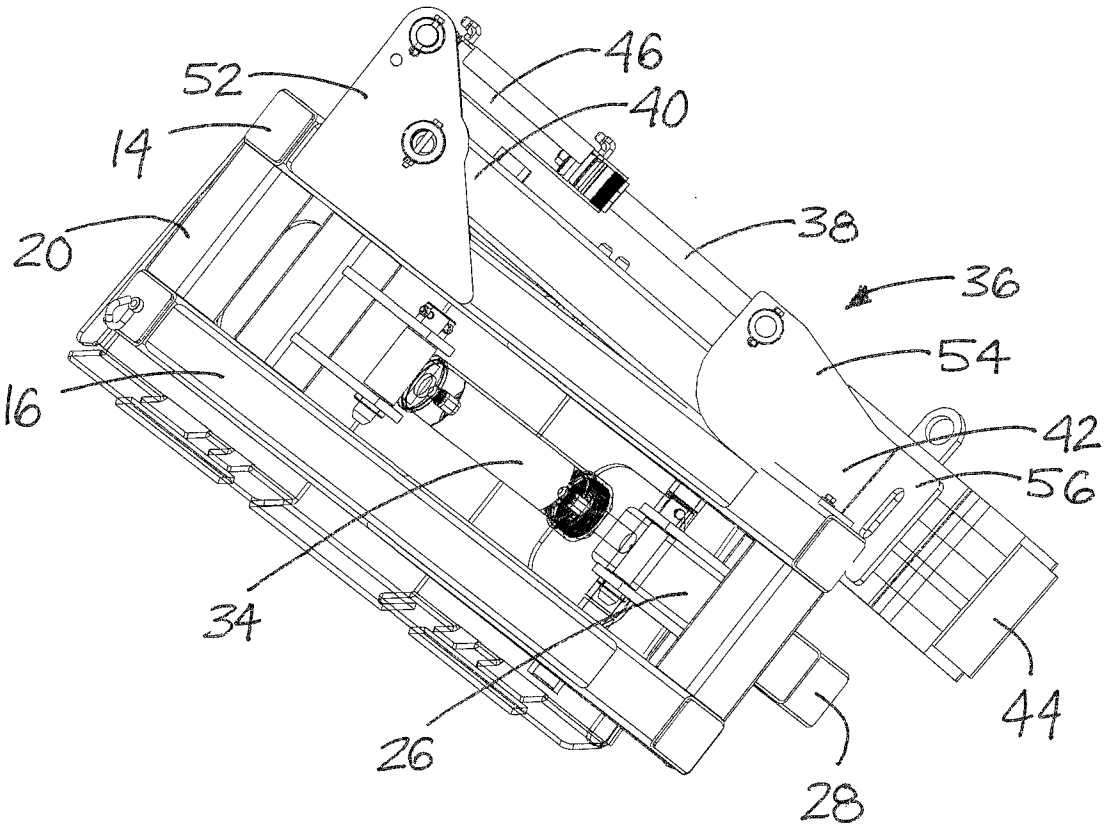
FIG. 3 is a schematic side view of the post driver and puller, according to an illustrative embodiment.
Figure 4:
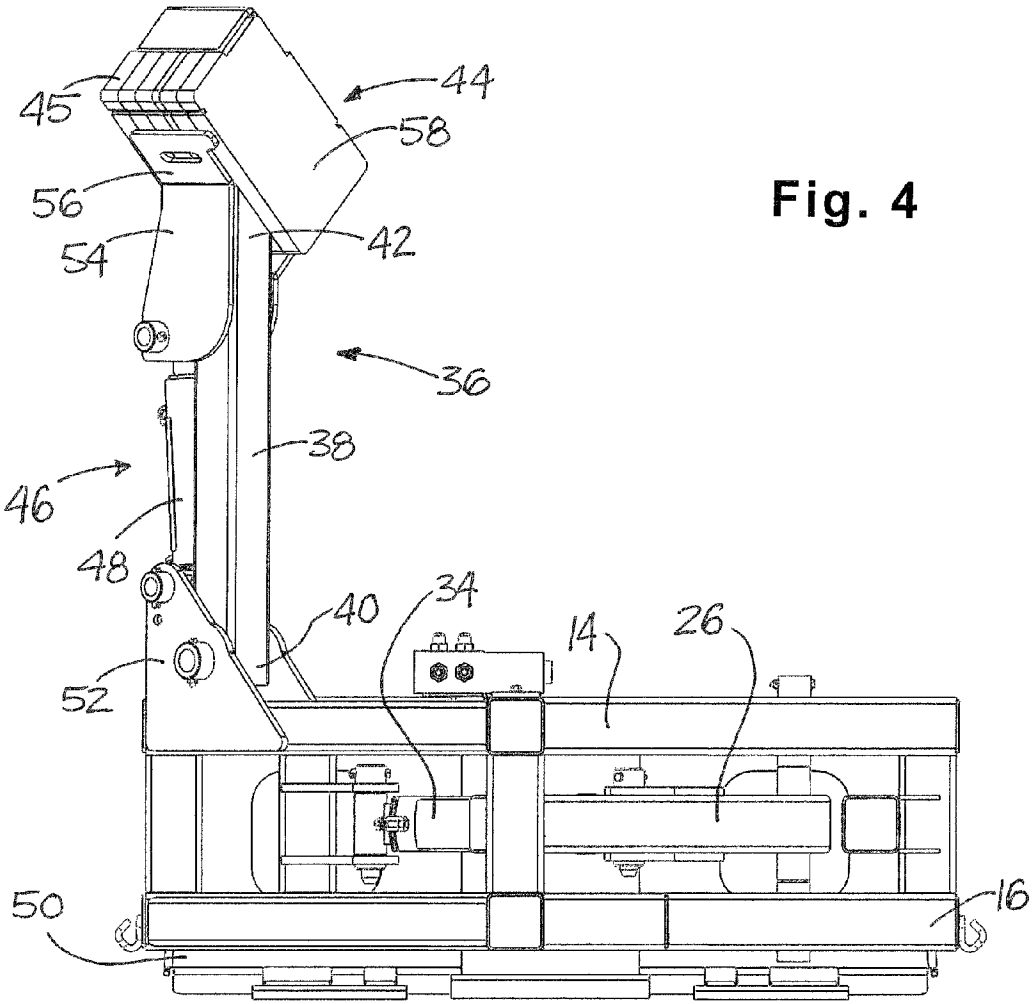
FIG. 4 is a schematic front view of the post driver and puller, according to an illustrative embodiment.
Figure 5:
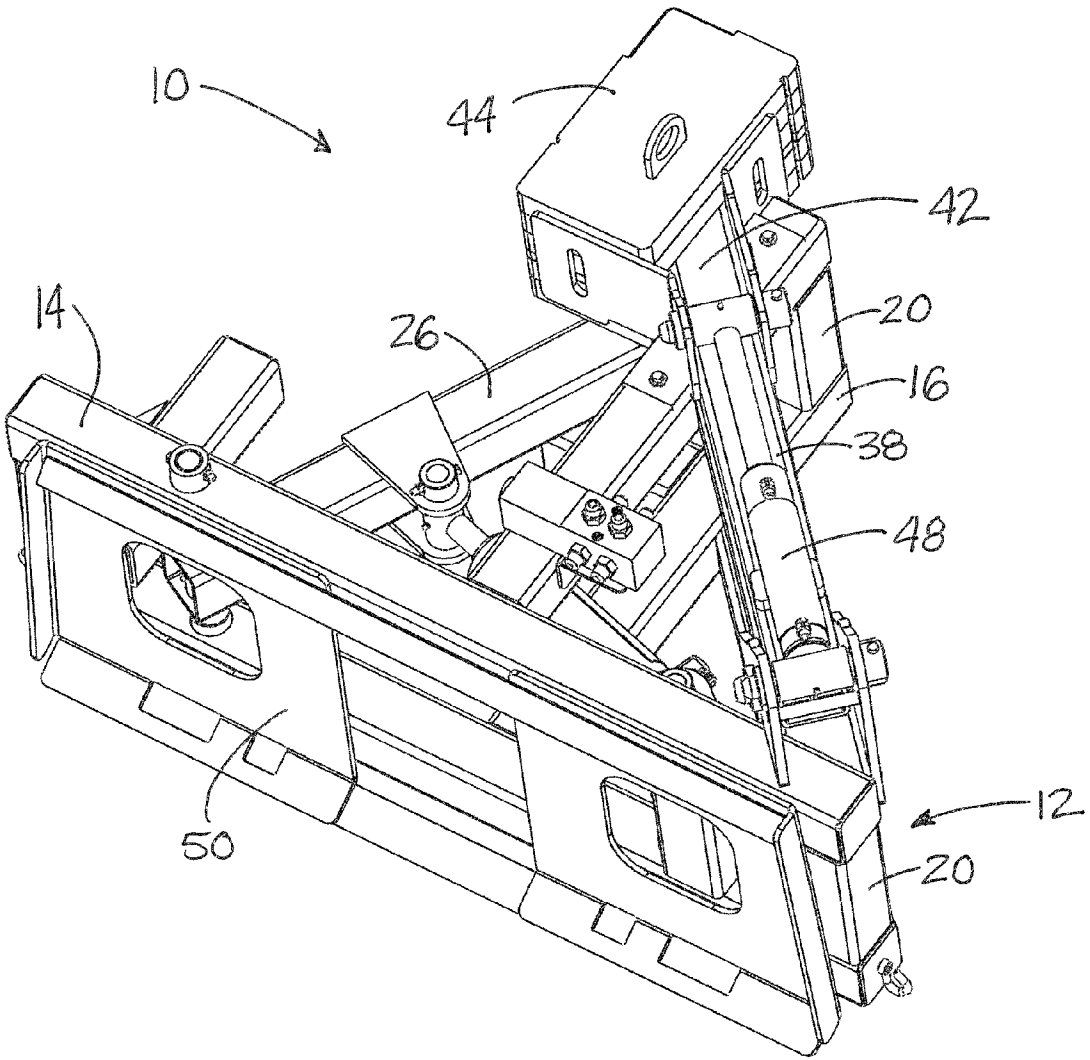
FIG. 5 is a schematic rear perspective view of the post driver and puller, according to the illustrative embodiment, showing the driver apparatus in a lowered position and the gripping apparatus in the pinch position.
Figure 6:
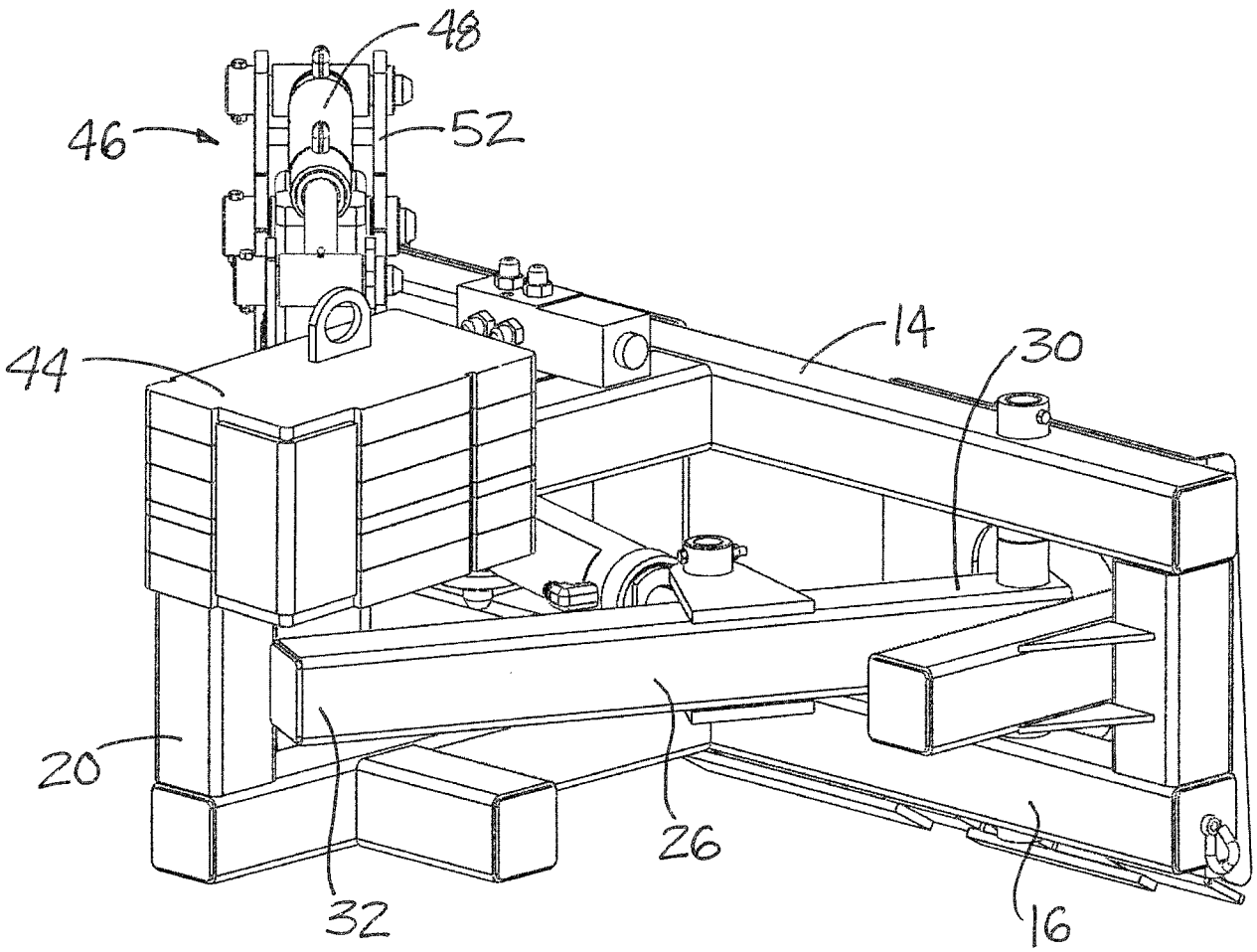
FIG. 6 is a schematic side perspective view of the post driver and puller, according to the illustrative embodiment, showing the driver apparatus in a lowered position and the gripping apparatus in the pinch position.
Figure 7:
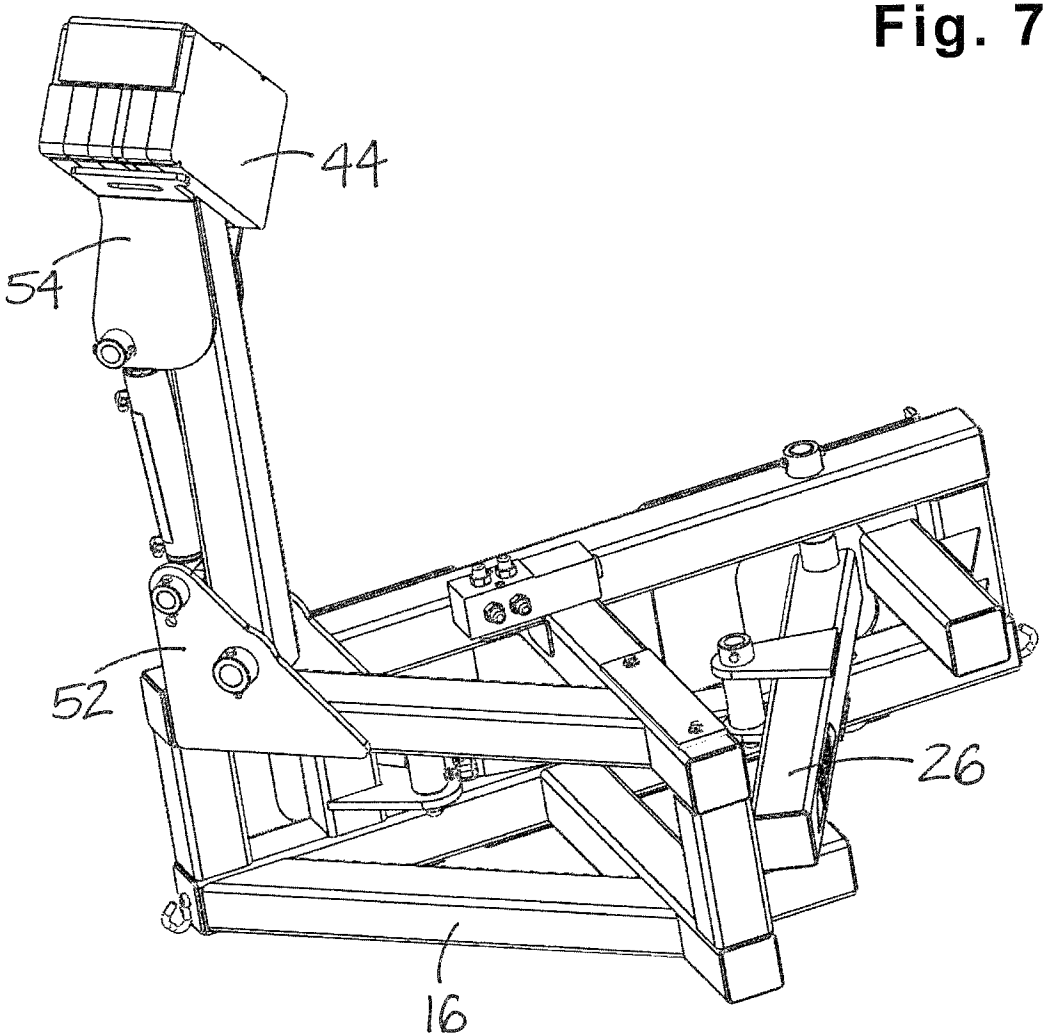
FIG. 7 is a schematic front perspective view of the post driver and puller, according to the illustrative embodiment, showing the driver apparatus in a raised position and the gripping apparatus in the pinch position.
Figure 8:
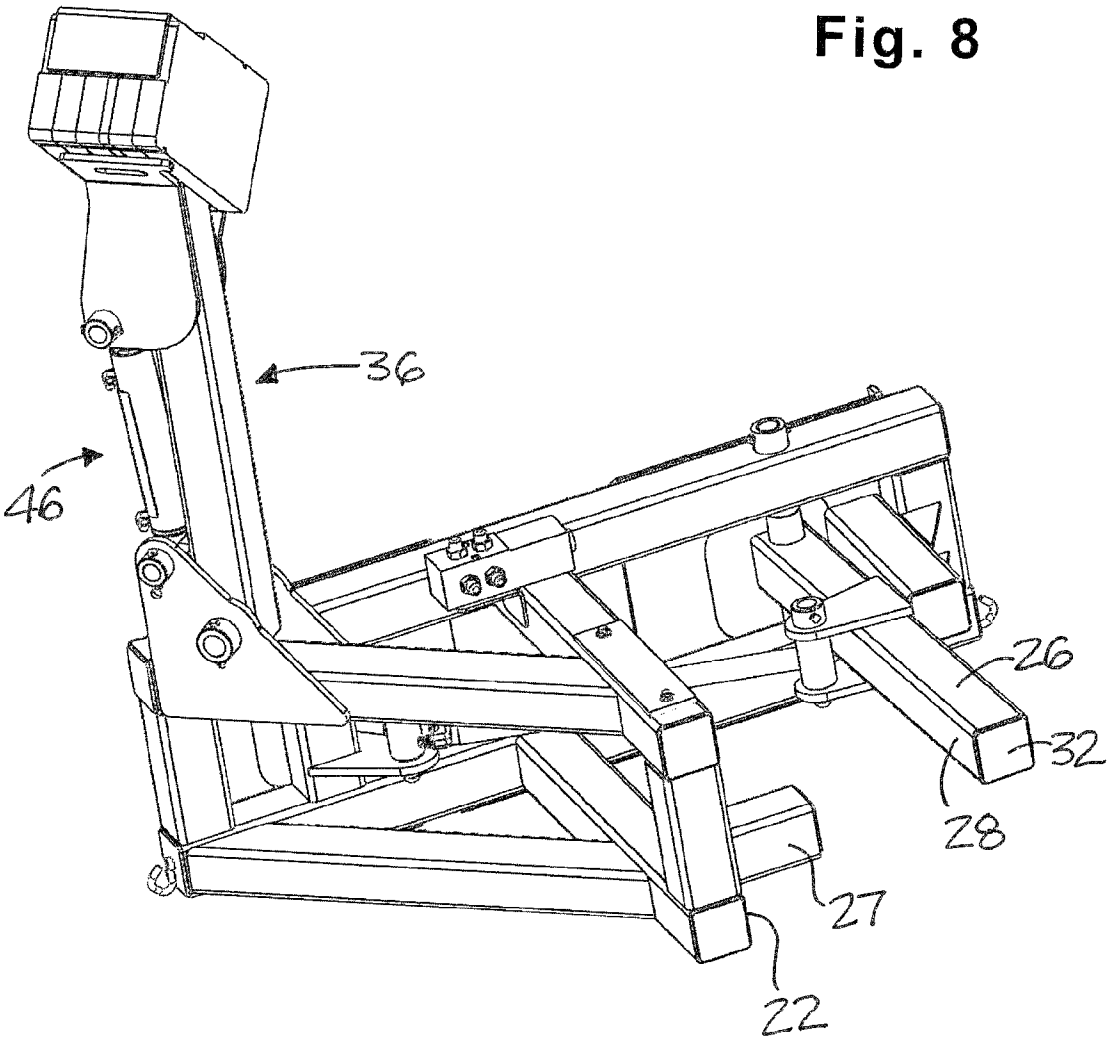
FIG. 8 is a schematic front perspective view of the post driver and puller, according to the illustrative embodiment, showing the driver apparatus in a raised position and the gripping apparatus in the release position.
Figure 9:
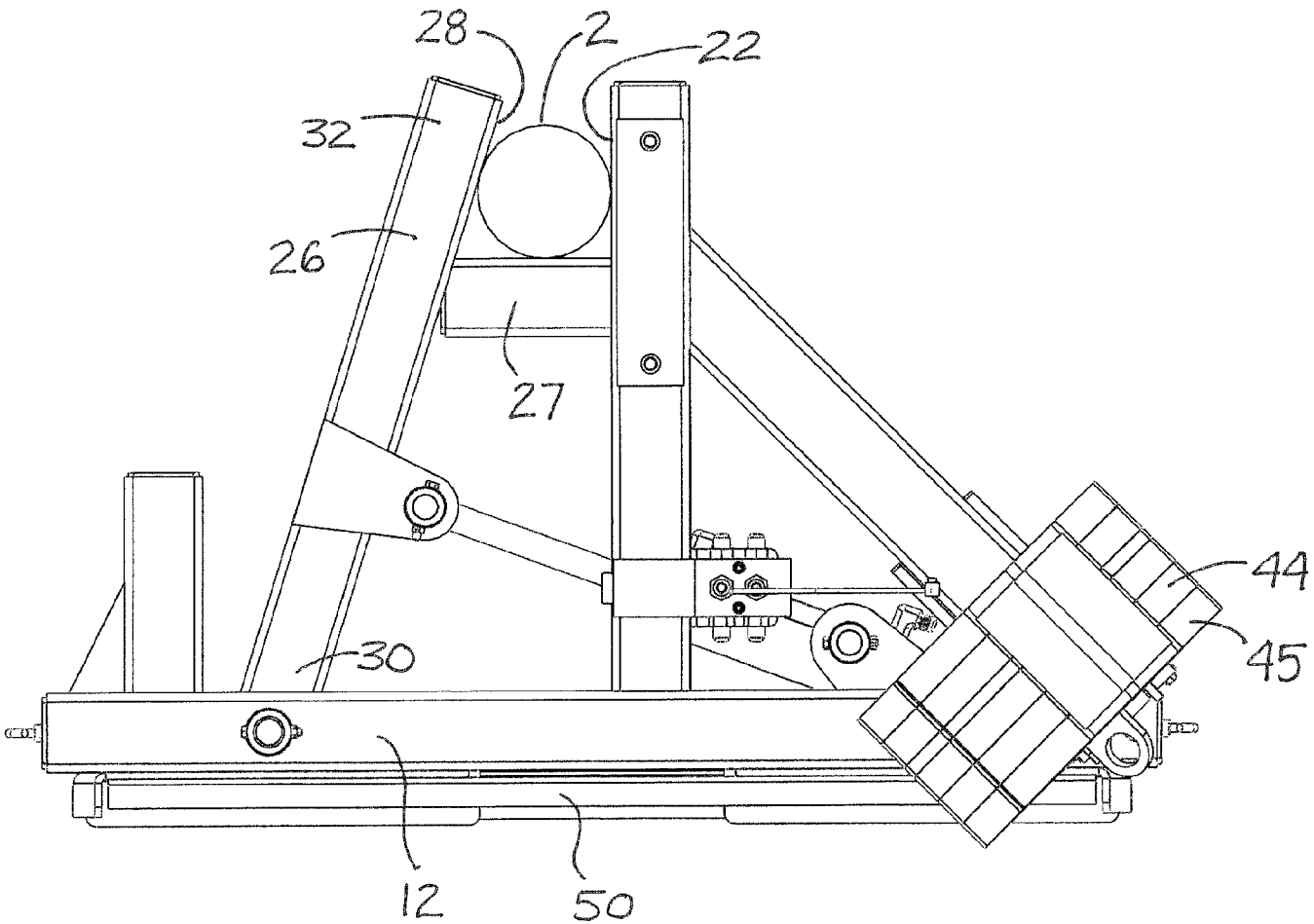
FIG. 9 is a schematic top view of the post driver and puller, according to the illustrative embodiment, showing the driver apparatus in a raised position and the gripping apparatus in the pinch position engaging a post.
Figure 10:
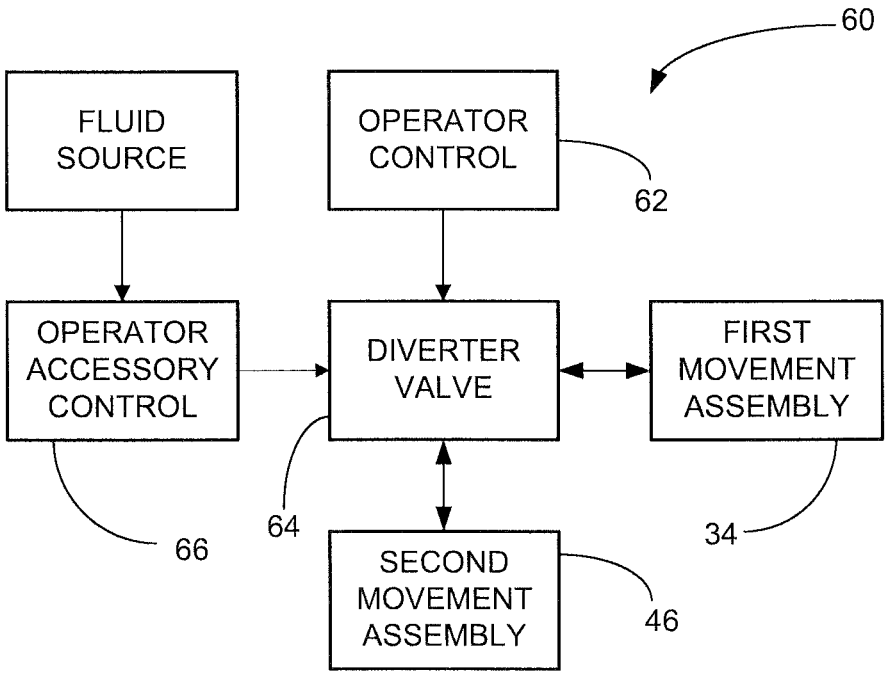
FIG. 10 is a schematic diagram of a control apparatus for the system.
Figure 11:
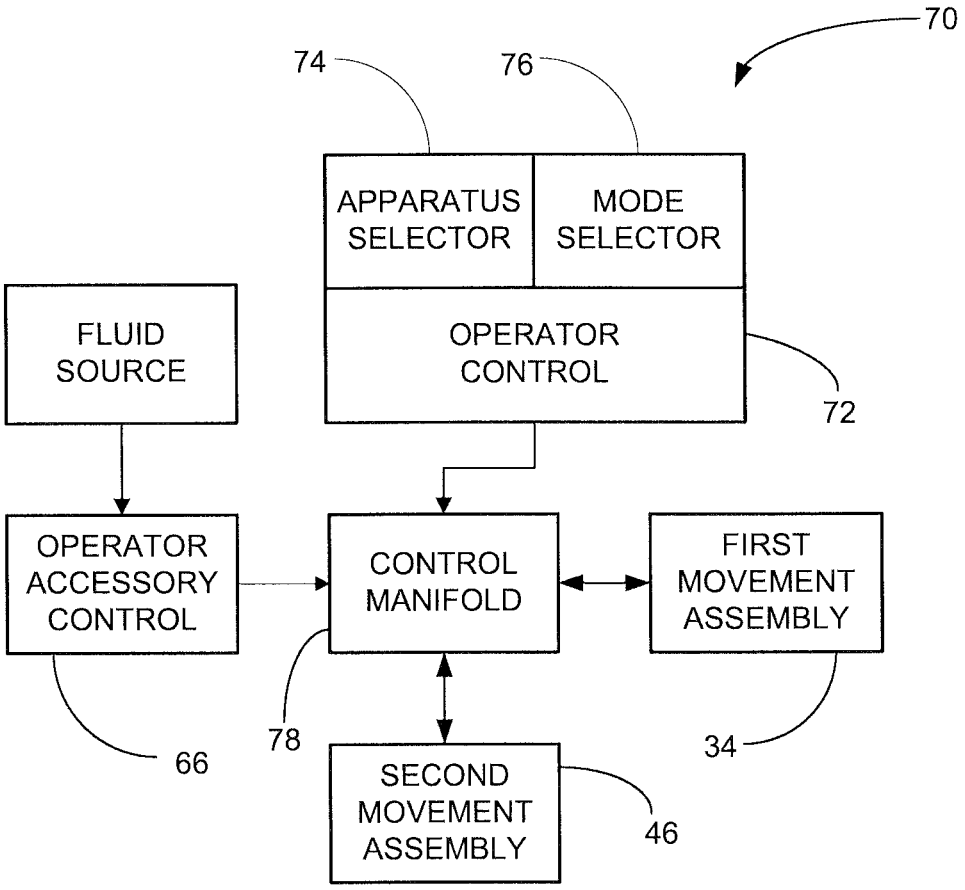
FIG. 11 is a schematic diagram of an optional control apparatus for the system.

With reference now to the drawings, and in particular to FIGS. 1 through 11 thereof, a new post driver and puller embodying the principles and concepts of the disclosed subject matter will be described.

This disclosure relates to a post driving and removal system 10 that is highly suitable for driving a post (such as a fence post) into a ground surface and also for removing a post that has been driven into the ground. Although the inclusion of the structure for performing both of the driving and pulling functions is not necessary to include in the system 10, it is highly useful to include the structure for performing both of these functions in the same machine to produce a compact and versatile system.

The system 10 may include a base frame 12, and that base frame may include an upper frame portion 14 that is located above a lower frame portion 16 when the frame 12 is oriented for use. A middle frame portion 18 may include a plurality of connecting members 20 that connect the upper frame portion 14 to the lower frame portion 16. The base frame 12 may define a base surface 22.

The system 10 may further a gripping apparatus 24 that is configured to selectively grip a post 2. The gripping apparatus 24 may be mounted on the base frame 12, and may be movable with respect to the base frame. More specifically, the gripping apparatus 24 may be pivotably movable with respect to the base frame 12. The gripping apparatus 24 may include a pinching member 26 that is pivotally mounted on the base frame 12. The pinching member may have a pinch surface 28. The pinching member 26 may be pivotable between a pinch position located toward the base surface 22 and a release position located away from the base surface. The pinching member 26 may be pivotable in a substantially horizontal plane between the respective positions. A wedge member 27 may be mounted on the base frame 12, and the wedge member 27 may include a surface that is oriented at an angle to the primary base surface 22, such as a substantially 90 degree angle, so that the post may be pressed or pinched against the base surface 22 and the wedge member 27 by the pinching member 26. The pinching member 26 may have a first end 30 that is pivotally mounted on the base frame 12, and a second end 32 with the pinch surface 28 being located thereon. Optionally, the pinching member 26 may include a structure for engaging, for example, a round metal fence post which typically has smaller diameter. A full or partial loop may be mounted on the main body of the pinching member 26 toward the second end 32 of the member 26. The loop may receive a portion of the small round post that might not otherwise be held by the pinch surface 28 and the base surface 22.

The gripping apparatus 24 may further include a first pivot assembly 34 that is configured to pivot the pinching member 26 between the pinch position and the release position. The first pivot assembly 34 may be mounted on the base frame 12 and the pinching member 26. The first pivot assembly 34 that is extendable to move the pinching member 26 toward the release position, and is retractable to move the pinching member 26 toward the pinch position. The first pivot assembly 34 may comprise a piston and cylinder actuator utilizing liquid or gas as the working fluid, and actuators of other types and configurations may also be employed.

The system 10 may further include a driver apparatus 36 that is configured to impact a post 2 held by the gripping apparatus 24. The driver apparatus 36 may be mounted on the base frame 12. The driver apparatus 36 may include an arm 38 that is movable with respect to the base frame 12 between a raised position and a lowered position. The arm 38 may be pivotally mounted on the base frame, and may be pivotable in a substantially vertical plane. The arm 38 may have a first end 40 that is pivotably mounted on the base frame 12, and the arm also has a second end 42. The lowered position of the arm 38 may be characterized by the arm 38 being in a substantially horizontal orientation, while the raised position of the arm 38 may be characterized by the arm 38 being inclined with the second end 42 being raised above the vertical level of the first end 40.

The driver apparatus 36 may further include an impact member 44 for impacting the post 2. The impact member 44 may be mounted on the arm 38, and may be mounted on the second end 42 of the arm such that moving the arm from the raised position to the lowered position brings the impact member 44 into contact with the post 2 being gripped by the gripping apparatus 24. The impact member 44 may have a significant weight that enhances the impact provided, and may comprise, for example, a plurality of metal plates 45.

The driver apparatus 36 may also include a second pivot assembly 46 configured to pivot the arm between the raised position and the lowered position. The second pivot assembly 46 may be mounted on the base frame 12 and the arm 38. The second pivot assembly 46 may be extendable to move the arm 38 toward the lowered position and retractable to move the arm toward the raised position, although this relationship could be reversed. The second pivot assembly 38 may comprise a piston and cylinder actuator 48 utilizing liquid or gas as the working fluid, and actuators of other types and configurations may also be employed.

The system 10 may also include a mounting structure 50 that is configured to mount the base frame 12 on a vehicle or other mobile base, such as a mobile base that is able to raise and lower the system relative to the ground surface. The mounting structure is mounted on the base frame. In the illustrative embodiment, the mounting structure 50 is adapted to mount the base frame 12 on a vehicle such as a skid steer loader which is ideal for vertically positioning the system 10 relative to the ground surface, although other types of vehicles, such as vehicles with conventional loader bucket supporting arms could also be used.

In use, a post 2 such as a wooden fence post may be gripped by the gripping apparatus 24 by positioning a portion of the fence post between the base surface 22 on the base frame 12 and the pinch surface 28 on the pinching member 26, and then actuating the first pivot assembly 34 to move the pinching member 26 and the pinching surface 28 toward the base surface 22 until the post is gripped with sufficient force between the surfaces 22, 28. Once gripped, the post 2 may be moved from one location to another, but more importantly may be moved into vertical, or substantially vertical, orientation at the location where the post is to be driven into the ground. Once the post has been positioned in this way, the post 2 may be gripped by the base 22 and pinch 28 surfaces toward the top end of the vertically oriented post, so that the top of the post is positioned somewhat above the lowest point in the swing path of the impact member when it moves toward the lowered position. The impact member 44 may be raised by moving the arm 38 to the raised position through the actuation of the second pivot assembly 46 in the appropriate manner. The impact member 44 is then moved downwardly in a relatively fast manner to impact the top of the post to drive downwardly. The impact member 44 is then raised and the process is repeated as the post is driven into the ground.

Optionally, the arms of the vehicle that support the system 10, such as on the aforementioned skid steer loader, may be moved downwardly to push the post against the ground surface. The arms of the skid steer loader may be moved downwardly to a degree that the front of the loader is lifted upwardly, and such that the front wheels of the loader are lifted off of the ground. As the gripping apparatus 24 continues to grip the post throughout the process, this action transfers a portion of the weight of the loader (or vehicle) to the post, providing further (continuous) downward force on the post to enhance the (periodic) downward force provided by the impact of the impact member on the post.

In greater detail, the actuator 48 of the second pivot apparatus 46 of the drive apparatus (as shown in FIGS. 1 through 4 as well as FIGS. 5 through 9 of the drawings) acts on the arm 38 supporting the impact member 44 from above the arm so as to push the arm and impact member in a downward direction, rather then attempting to pull the arm and impact member in a downward direction. In a system 10 employing hydraulic fluid to move the actuator 48, the positioning of the actuator in a position above the arm allows the hydraulic fluid forced into the actuator to extend the actuator to thereby push the impact member against the top of the post, rather than other positionings which require the arm and impact member to be pulled downwardly onto the post. Conversely, retracting the actuator pulls on the arm and thereby lifts the arm in an upward direction.

In some embodiments, an inboard mount 52 that mounts the inboard end of the actuator 48 to the arm 38 also functions to mount the arm 38 to the upper frame portion 14, so that these mounts are integrated together, and thus both the arm 38 and the actuator 48 pivot on the same mounting element, although about different axes. Also, in some embodiments, the outboard mount 54 for the actuator 48 on the arm 38 is integrated with the support 56 forming a portion of the impact member 44 so that the force of the actuator is applied to the impact member and not directly to the arm 38. The outboard mount 54 may thus not only form a point for mounting the actuator 48 to the arm 38, but also for mounting the impact member 44 to the arm 38.

In the illustrative embodiments, the actuator 48 and the arm 38 may thus form a pair of substantially parallel links supporting the impact member 44. In these configurations where the actuator 48 is positioned above the arm 38, the actuator and the arm form a relatively compact assembly on the system 10, and the relatively close positioning of the arm 38 to the actuator helps to protect the actuator 48 from damage.

Further, as shown in FIGS. 1 through 4 as well as FIGS. 5 through 9, the impact member 44 of the driver apparatus 36 may comprise a plurality of individual plates 45 that are stacked on each other. Plates may be removed or added to the stack to adjust the weight of the impact member, if desired. The plates 45 comprising the stack may be configured such that the face 58 on the lower surface of the impact member 44 has a length that is greater than the width, and the length may be approximately twice the width of the face 58 (see, for example, FIG. 2). This relationship helps to provide a face with a broader area for striking the top of a post, and thus makes precise positioning of the post less important. In some embodiments, the length of the face 58 may be greater than a height of the impact member as measured in a direction substantially perpendicular to the plane of the face. In some embodiments, the length may be approximately twice the height of the impact member.

In some embodiments of the system 10, a control apparatus 60 (see FIG. 10) is employed to control the operation of the system, such as, for example, the gripping apparatus 24 and the driver apparatus 36. The operator of the system 10 may actuate or operate an operator control 62 which controls the flow of fluid to the first movement assembly 34 to operate the gripping apparatus 24, and to the second movement assembly 46 to operate the driver apparatus. The operator control 62 may be linked to a diverted valve 64 which controls and directs the flow of fluid received from a fluid source to one or both of the first 34 and second 46 movement assemblies. In some implementations, the link between the operator control 62 and the diverter valve 64 is electrical, although a linkage using other technology may be employed. Illustratively, the operator control 62 may be an electric switch located in a cab or cockpit of the vehicle supporting the system 10, and the diverter valve 64 may include a solenoid to actuate the valve body, and may be located on the base frame 12. Once the first movement assembly 34 or the second movement assembly 46 is selected, then the control 66 for the vehicle hydraulic accessory output may be utilized to control the actual operation of the respective assembly 34 or 46 and the respective apparatus 24 or 36. The accessory control 66 may be cycled back and forth from one direction to the other direction to cause the driver apparatus to impact the post.

In other embodiments of the system 10, an optional control apparatus 70 (see FIG. 11) may be employed in which the operator has the ability to choose between manual mode of operation or actuation of the first movement assembly and thus the driver assembly, or an automated mode of operation in which the system 10 is able to cause the driver assembly to impact the post in a repeated manner without the operator having to actuate a control to cause each impact. In this embodiment, an operator control 72 includes an apparatus selector 74 for selecting the apparatus (e.g., gripping or driver) to be operated by the accessory control 66 of the hydraulic system of the vehicle, and also includes a mode selector 76 that allows the operator to select between the manual mode of operating the driver assembly and the automated mode of operating the driver assembly. The control apparatus 70 includes a control manifold 78 that is controlled by the operator control 72 and the selectors thereof, and that directs fluid flow from the hydraulic system to the selected assembly in the selected manner or mode.

When the automated mode is selected, the control manifold 78 acts to direct fluid to second movement assembly 46 in a manner that causes the actuator 48 to reciprocate between extended and retracted conditions, and thereby causes the arm and the impact member thereon to move upwardly and downwardly to impact a post gripped by the gripping apparatus. In the automated mode, repeated movements of a control or switch by the operator are not required to cause the reciprocating movement of the actuator or the impact member. Optionally, the control manifold 78 may employ a regenerative hydraulic circuit to cause hydraulic fluid to be supplied to the actuator 48 at a higher rate when the actuator is being extended (and the impact member is being lowered) than when the actuator is being retracted (and the impact member is being raised). This implementation results in a greater impact on the post, and further results in faster driving of the post into the ground.

As can be appreciated, the gripping apparatus 24 may be used to grip a portion of a previously buried or driven post that extends from the ground surface between the base 22 and pinch 28 surfaces, and the arms of the skid steer vehicle may be utilized to apply a vertically upward lifting force to the post through the system 10 to remove the post from the ground.

It should also be recognized that the system 10 may be configured to provide the post pulling or removal function to remove the post from being lodged in the ground or the post pounding or driving function, or both functions. The illustrative embodiments of this disclosure show an apparatus configured to provide both functions, although it is within the scope of the disclosure to implement an apparatus in which only sufficient structure is provided for performing, for example, the pulling or removal function. In such case, the driver apparatus 36 may be omitted from the system 10, and the base frame 12 and the gripping apparatus 24 retained to provide the removal functionality. It is also anticipated that the driver apparatus 36 could be included on the base frame 24 without the gripping apparatus 24, although use of the gripping apparatus during post pounding or driving operations contributes significantly to the stability and accuracy of the post driving action.

Additionally, where the pinching member 26 and the arm 38 are described as being pivotally movable with respect to the base frame 12, it will be recognized that pivotal movement by the pinching member and the arm is not critical to the operation of the system 10, and the movement may be other than pivotal, such as, for example, translational or rotational. therefore, the first and second pivot assemblies may comprise first and second movement assemblies.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm movable with respect to the base frame between the raised position and a lowered position;

an impact member mounted on the arm and being movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the second movement assembly comprises a piston and cylinder actuator movable to move the arm between the raised and lowered positions, the actuator being positioned over the arm to push the arm downwardly.

2. The system of claim 1 wherein the second movement assembly comprises a piston and cylinder actuator movable to move the arm between the raised and lowered positions, the actuator being positioned over the arm to push the arm downwardly.

3. The system of claim 1 wherein the piston and cylinder actuator has a longitudinal axis oriented substantially parallel to a longitudinal axis of the arm.

4. The system of claim 1 wherein the piston and cylinder actuator is extendable and retractable and is mounted such that extension of the actuator moves the arm toward the lowered position and retraction of the actuator moving the arm toward the raised position.

5. The system of claim 1 wherein the second movement assembly comprises an inboard mount that mounts the actuator to the base frame and further mounts the arm to the base frame.

6. The system of claim 1 wherein the second movement assembly comprises an outboard mount that mounts the actuator to the arm and further mounts the impact member to the arm.

7. The system of claim 1 wherein the actuator is configured to pull the arm upwardly to move the arm toward the raised position.

8. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm pivotally movable with respect to the base frame between the raised position and a lowered position;

an impact member mounted on the arm and being swung downwardly in an arc by the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the pinching member is configured to swing in a substantially horizontal plane to contact a post.

9. A post driving and removal system comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm movable with respect to the base frame between the raised position and a lowered position;

an impact member mounted on the arm and being movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the arm is pivotally mounted on the base frame, the arm being pivotable in a substantially vertical plane, the lowered position of the arm being characterized by the arm being substantially horizontal, the raised position of the arm of the arm being characterized by the arm being inclined with the impact member being raised above the vertical level of the first end.

10. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm movable with respect to the base frame between the raised position and a lowered position;

an impact member mounted on the arm and being movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the impact member comprises a plurality of plates in a stack, at least one of the plates being removable to adjust a weight of the impact member at an outboard end of the arm.

11. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm movable with respect to the base frame between the raised position and a lowered position;

an impact member mounted on the arm and being movable with the arm to impact the post gripped by the gripping apparatus, the arm swinging the impact member to a position vertically aligned with a longitudinal axis of the post when the arm is in the lowered position from a position horizontally displaced from the longitudinal axis of the post when the arm is in the raised position; and a second movement assembly configured to move the arm between the raised position and the lowered position, the second movement assembly being located above the arm to push the arm downwardly to move the arm toward the lowered position to contact the impact member against the post gripped by the gripping assembly;

wherein the impact member has a planar face for contacting a post gripped by the gripping apparatus, the planar face having a length that is greater than a width of the face.

12. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm pivotally movable with respect to the base frame between the raised position and a lowered position;

an impact member mounted on the arm and being pivotally movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the impact member has a planar face for contacting a post gripped by the gripping apparatus, the planar face having a length, the impact member having a height dimension measured substantially perpendicular to a plane of the face, the planar face having a length greater than the height of the impact member.

13. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm pivotally movable with respect to the base frame between the raised position and a lowered position;

an impact member mounted on the arm and being pivotally movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

a control apparatus configured to supply working fluid to the second movement assembly, the control apparatus having a mode of operation in which fluid is supplied to the second movement assembly in a manner such that an actuator of the second movement assembly is repeatedly reciprocated between extended and retracted positions without operation intervention to cause each reciprocation.

14. The system of claim 1 wherein the second movement assembly comprises an actuator movable to move the arm between the raised and lowered positions, the actuator being positioned above the arm to push the arm downwardly;

wherein the actuator has a longitudinal axis oriented substantially parallel to a longitudinal axis of the arm;

wherein the actuator is extendable and retractable and is mounted such that extension of the actuator moves the arm toward the lowered position and retraction of the actuator moving the arm toward the raised position;

wherein the second movement assembly comprises an inboard mount that mounts the actuator to the base frame and further mounts the arm to the base frame;

wherein the second movement assembly comprises an outboard mount that mounts the actuator to the arm and further mounts the impact member to the arm; and wherein the actuator is configured to pull the arm upwardly to move the arm toward the raised position.

15. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between a pinch position to grip the post against the base frame and a release position to release the post from being gripped between the pinching member and the base frame, the pinching member being pivotable in a horizontal axis about a vertical axis to engage the post; and a first movement actuator configured to move the pinching member between the release position and a plurality of pinch positions;

a driver apparatus mounted on the base frame and being configured to impact a post held by the gripping apparatus, the driver apparatus comprising:

an arm having a first end pivotally mounted to the base frame at a pivot such that the arm is pivotally movable with respect to the base frame between the raised position and a lowered position, the arm having second opposite of the first end;

an impact member mounted on the arm and being pivotally movable with the arm to impact the post gripped by the gripping apparatus, the arm including a rigid beam connecting the impact member to the pivot; and a second movement assembly configured to move the arm between the raised position and the lowered position, the second movement assembly comprising:

an actuator movable to move the arm between the raised and lowered positions, the actuator being positioned over the arm to push the arm downwardly, the actuator being mounted on the base frame and on the arm adjacent to the second end to move the arm toward the lowered position to contact the impact member against the post gripped by the gripping assembly;

wherein the actuator has a longitudinal axis oriented substantially parallel to a longitudinal axis of the arm;

wherein the actuator is extendable and retractable and is mounted such that extension of the actuator pivots the arm toward the lowered position and swings the impact member into contact with an upper end of the post, and such that retraction of the actuator pivots the arm toward the raised position;

wherein the second movement assembly comprises an inboard mount that pivotally mounts the actuator to the base frame and further pivotally mounts the arm to the base frame;

wherein the second movement assembly comprises an outboard mount that mounts the actuator to the arm and further mounts the impact member to the arm; and wherein the actuator is configured to pull the arm upwardly to move the arm toward the raised position.

16. The system of claim 2 wherein the actuator has a longitudinal axis oriented substantially parallel to a longitudinal axis of the arm;

wherein the actuator is extendable and retractable and is mounted such that extension of the actuator moves the arm toward the lowered position and retraction of the actuator moving the arm toward the raised position;

wherein the second movement assembly comprises an inboard mount that mounts the actuator to the base frame and further mounts the arm to the base frame;

wherein the second movement assembly comprises an outboard mount that mounts the actuator to the arm and further mounts the impact member to the arm; and wherein the actuator is configured to pull the arm upwardly to move the arm toward the raised position.

17. The system of claim 15 wherein the impact member comprises a plurality of plates in a stack, at least one of the plates being removable to adjust a weight of the impact member at an outboard end of the arm.

18. A post driving and removal system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between pinch position to grip the post against the base frame and a release position to release the post from being gripped between the pinching member and the base frame; and a first movement assembly configured to move the pinching member between the pinch position and the release position;

a driver apparatus mounted on the base frame and being configured to impact a post held by the gripping apparatus, the driver apparatus comprising:

an arm pivotally movable with respect to the base frame between the raised position and a lowered position;

an impact member mounted on the arm and being pivotally movable with the arm to impact the post gripped by the gripping apparatus; and a second movement assembly configured to move the arm between the raised position and the lowered position, the second movement assembly being located above the arm to push the arm downwardly to move the arm toward the lowered position to contact the impact member against the post gripped by the gripping assembly;

wherein the gripping apparatus is configured to engage the post in a manner such that an upper end of the post is left exposed to be contacted by the swinging impact member.

19. A post driving system, comprising:

a base frame;

mounting structure mounted on the base frame and configured to mount the base frame on a mobile base;

a gripping apparatus mounted on the base frame and configured to selectively grip a post, the gripping apparatus including:

a pinching member movably mounted on the base frame, the pinching member being movable between a pinch position to grip the post and a release position to release the post from being gripped, the pinch position of the pinching member being configured to hold the post in at least a substantially vertical orientation; and a first movement assembly configured to move the pinching member between the pinch position and the release position;

a driver apparatus mounted on the base frame and being configured to impact a post, the driver apparatus comprising:

an impact member pivotally movable with respect to the base frame in a vertical plane from a raised position to a lowered position to impact the post, the pinching member being configured to grip the post in a pinch position with an upper end of the post in vertical alignment with the lowered position of the impact member; and a guide configured to guide movement of the impact member between the raised position and the lowered position to impact the upper end of the post, the guide being configured to guide movement of the impact member in the vertical plane and constrain movement of the impact member horizontally with respect to the vertical plane;

a second movement assembly configured to move the impact member between the raised position and the lowered position.

* * * * *